US011731245B1

(12) United States Patent
Marchisset

(10) Patent No.: US 11,731,245 B1
(45) Date of Patent: Aug. 22, 2023

(54) INLINE CLAMP

(71) Applicant: Roger Marchisset, Rancho Cucamonga, CA (US)

(72) Inventor: Roger Marchisset, Rancho Cucamonga, CA (US)

( * ) Notice: Subject to any disclaimer, the term of this patent is extended or adjusted under 35 U.S.C. 154(b) by 0 days.

(21) Appl. No.: 18/088,136

(22) Filed: Dec. 23, 2022

(51) Int. Cl.
*B25B 5/00* (2006.01)
*B25B 5/04* (2006.01)
*B25B 5/10* (2006.01)

(52) U.S. Cl.
CPC . *B25B 5/04* (2013.01); *B25B 5/10* (2013.01)

(58) Field of Classification Search
CPC .... B25B 3/00; B25B 5/00; B25B 5/02; B25B 5/04; B25B 5/12; B25B 27/00
See application file for complete search history.

(56) References Cited

U.S. PATENT DOCUMENTS

D350,469 S * 9/1994 Sawdon ..... D8/72
5,557,833 A * 9/1996 Pool ..... B25B 27/023 29/261
6,893,012 B2 * 5/2005 Wong ..... B25B 5/103 269/239
6,895,646 B1 * 5/2005 Houg ..... B25B 27/026 29/261
7,909,314 B2 * 3/2011 Roesch ..... B25B 5/166 269/166
8,517,365 B2 * 8/2013 Velez ..... B25B 5/147 29/259
11,396,093 B2 * 7/2022 Hu ..... B25B 27/023

* cited by examiner

*Primary Examiner* — Lee D Wilson
(74) *Attorney, Agent, or Firm* — The Law Office of Austin Bonderer, PC; Austin Bonderer

(57) ABSTRACT

An apparatus having a clamp configured to move between an open position and a closed position. The clamp has an actuator, a head, a base, two or more arms, and two abutments. The actuator extends through the head and the base. The two or more arms are coupled to the head and the base. The two abutments abut each other when the clamp is in the closed position.

19 Claims, 6 Drawing Sheets

INLINE CLAMP

BACKGROUND

Clamps are some of the oldest tools used to hold items in place. The ability to secure items is advantageous in all kinds of situations, including, but not limited to, fabrication and welding.

BRIEF DESCRIPTION OF THE DRAWINGS

Implementations of the present technology will now be described, by way of example only, with reference to the attached figures, wherein.

DETAILED DESCRIPTION

Figure 1:
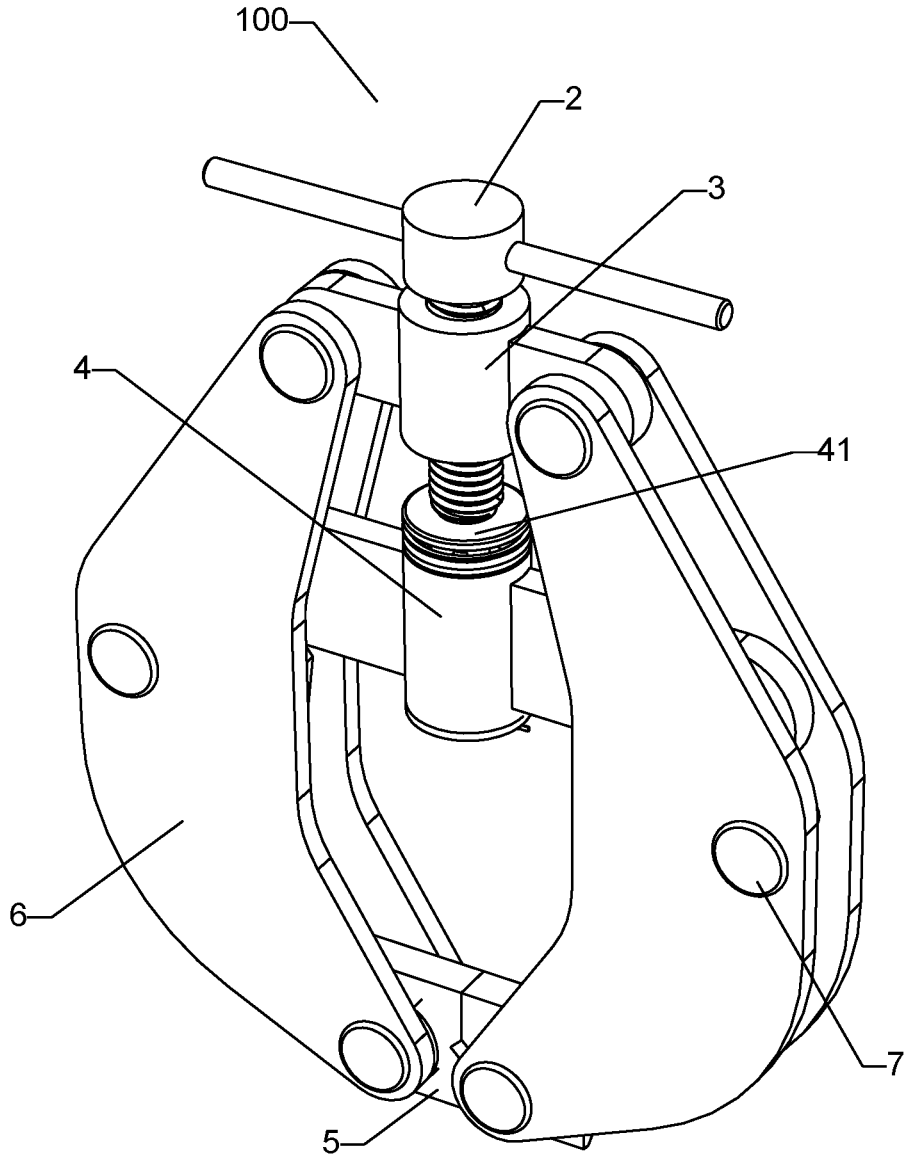
FIG. 1 shows an embodiment of a clamp.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein. It should be noted that references to "an" or "one" embodiment in this disclosure are not necessarily to the same embodiment, and such references mean at least one.

Several definitions that apply throughout this disclosure will now be presented.

The term "coupled" is defined as connected, whether integral with, directly attached, or indirectly attached through intervening components, and is not necessarily limited to physical and/or ridged connections. The connection can be such that the objects are permanently connected or releasably connected. The term "rotationally coupled" is defined as connected, whether integral with, directly attached, or indirectly attached through intervening components, allows for rotational movement, and is not necessarily limited to physical and/or ridged connections. It is to be understood that the term "coupled" can also include rotationally coupled elements. The term "outside" indicates at least a portion of a region beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" means "including, but not necessarily limited to"; it specifically indicates open-ended inclusion or membership in a so-described combination, group, series and the like.

The present disclosure is described in relation to a clamp 100 with the ability to provide engagement that engages from both sides.

FIG. 1 illustrates an embodiment of a clamp 100. In some embodiments, the clamp 100 comprises an actuator 2, a head 3, a base 4, and arms 6. In some embodiments, the two arms 6 are coupled to the head 3 and the base 4, and the arms 6 are configured to move in relation thereto. In some embodiments, the clamp 100 further comprises abutments 5 coupled to the arms 6. In some embodiments, the base 4 is coupled to the abutments 5. In some embodiments, the clamp 100 further comprises connectors 7 that couple at least the head 3 and the base 4 to the arms 6. In some embodiments, the clamp 100 further comprises a stop 41 located between the base 4 and the head 3.

Figure 2:
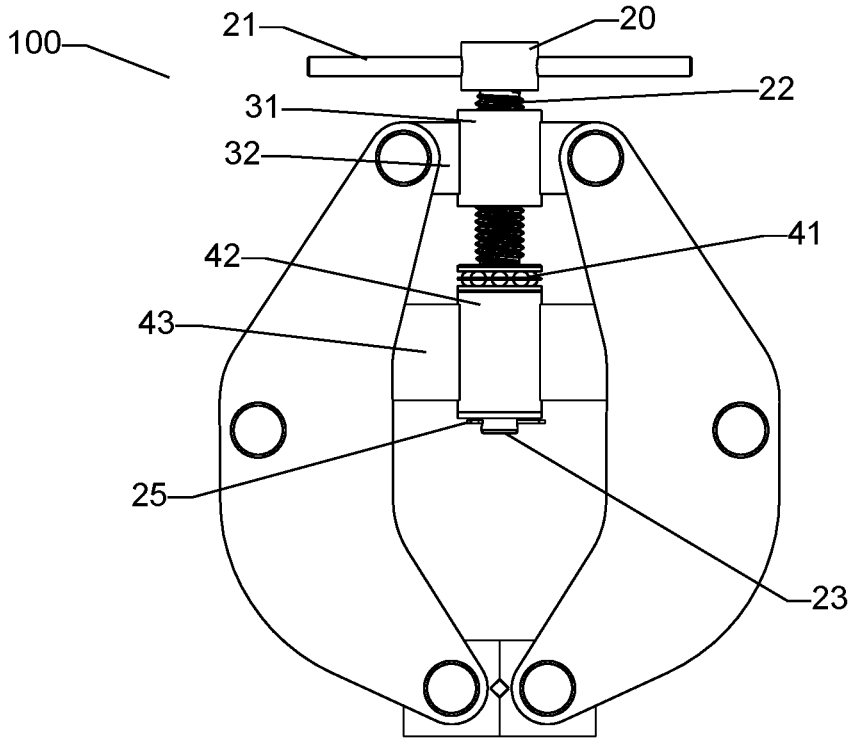
FIG. 2 shows an embodiment of a clamp in a closed position.

FIG. 2 illustrates an embodiment of the clamp 100 in a closed position. In some embodiments, the actuator 2 comprises an actuator knob 20. The actuator knob 20 is coupled to the actuator extension 22 and capable of translating movement from the actuator knob 20 to the actuator extension 22. In some embodiments, the actuator 2 comprises an actuator arm 21 that is coupled to the actuator knob 20 and will enable a user to increase the rotational force to the actuator knob 20. In some embodiments, the actuator arm 21 can slide inside the actuator knob 20 such that the actuator arm 21 is wholly or partially located on one side of the actuator arm 21. In some embodiments, there are two or more actuator arms 21. In some embodiments, the actuator extension 22 comprises a head engagement 221 that engages the head 3. In some embodiments, the head engagement 221 comprises a thread that corresponds to a head internal thread 311. When the actuator 2 rotates, the actuator 2 will move linearly relative to the head 3 and move the base 4 closer to or further away from the head 3; thus actuating the clamp 100 from and open position to a closed position, and vice versa. In some embodiments, the actuator extension 22 comprises a base engagement 222. In some embodiments, the actuator 2 further comprises an actuator-base engagement 23 located below the base 4. In some embodiments, the actuator-base engagement 23 comprises a plate 231. In some embodiments, the actuator 2 is configured to rotate within the base 4, and the plate 231 is configured to rotate freely but abut the base 4 and draw the base 4 closer to the head 3.

In some embodiments, the base 4 comprises a base center 42 that engages the actuator extension 22. In some embodiments, the base center 42 has a portion of the actuator extension 22 located therein. In some embodiments, the base center 42 is coupled to the actuator extension 22; in some embodiments, the base center 42 and the actuator extension 22 are integral to the base center 42. In some embodiments, the base 4 comprises the base center 42 and the base extensions 43 coupled to the base center 42. In some embodiments, the base extensions 43 are coupled to the arms 6.

In some embodiments, the clamp 100 comprises a stop 41. In some embodiments, the stop 41 is located between the head 3 and the base 4. In some embodiments, the stop 41 is coupled to the base 4. In some embodiments, the stop 41 comprises an o-ring. In some embodiments, the stop 41 comprises ball bearings 412 (See FIG. 4). In some embodiments, the ball bearings 412 are located in a space defined by the upper stop housing 411 and the lower stop housing 413. The stop 41 will force the base 4 down when the actuator 2 moves the clamp 100 towards the closed position. In some embodiments, the stop 41 will pull, or help pull, the base 4 up when the actuator 2 moves the clamp 100 towards the open position.

In some embodiments, the actuator 2 is coupled to a base attachment 25 located below the base 4, such that when the actuator 2 is moved upward, the base 4 is also moved upward, relative to the head 3. In some embodiments, the base attachment 25 comprises a washer; in some embodiments, the washer is secured by a cotter pin. In some embodiments, the base attachment 25 comprises an E-Clip. In some embodiments, the base attachment 25 allows for rotational movement of the actuator 2 in relation to the base 4

Figure 3:
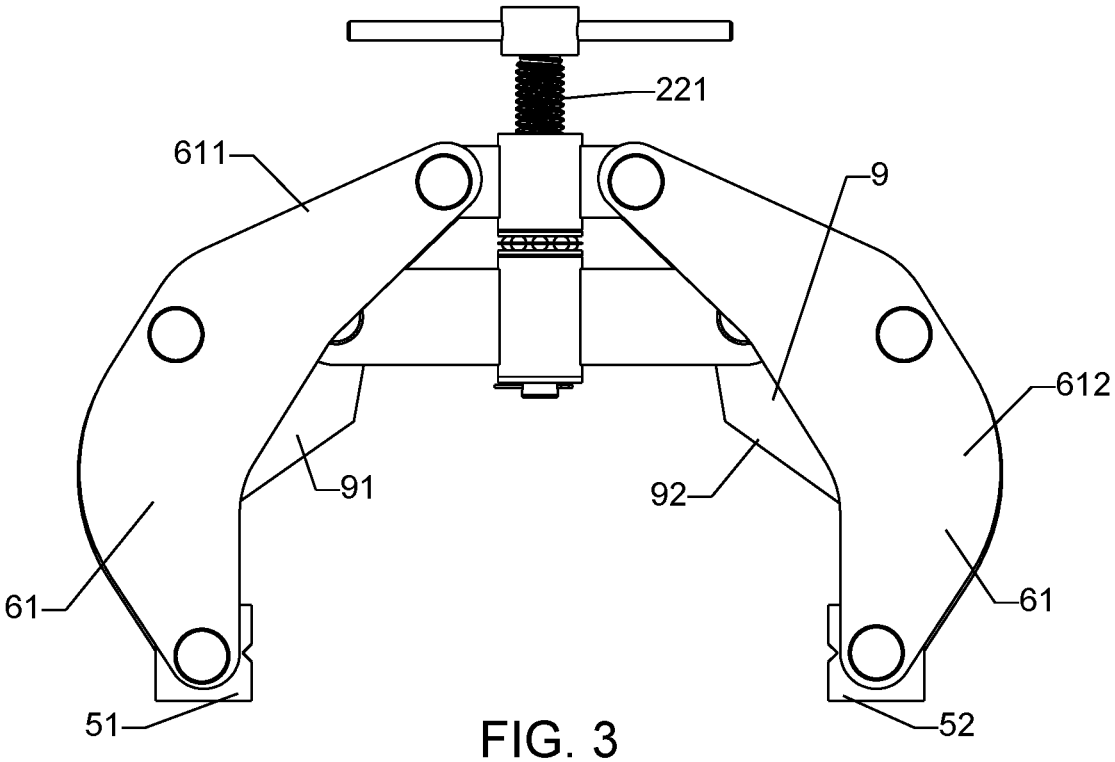
FIG. 3 shows an embodiment of a clamp in an open position.

FIG. 3 illustrates an embodiment of the clamp 100 in an open position. In some embodiments, the clamp 100 further comprises upper pusher links 9, and each upper pusher link 9 couples the base 4 to the lower pusher links 10. Each lower pusher link 10 is rotationally coupled to the upper pusher link 9 and the abutment 5 and/or the arm 6 The upper pusher links 9 are rotationally coupled to the lower pusher links 10 and the base 4. The upper pusher links 9 and the lower pusher links 10 are shaped such that when the base 4 is moved toward the head 3, the upper pusher links 9 and the lower pusher links 10 will push the abutments 5 (and/or the arms 6) away from each other, and when the base 4 is moved away from the head 3, the upper pusher links 9 will push the abutments 5 (and/or the arms 6) toward each other.

In some embodiments, the abutments 5 comprise a left abutment 51 and a right abutment 52. In some embodiments, the left abutment 51, the right abutment 52, or both are rotationally coupled to the arm 6, the lower pusher link 10, or both. In some embodiments, one or more of the abutments 5 comprise a securing groove. In some embodiments, when the abutments 5 abut each other and both define a securing groove, they can define a securing space 501. In some embodiments, the abutments 5 are located outside the arms 6.

Figure 4:
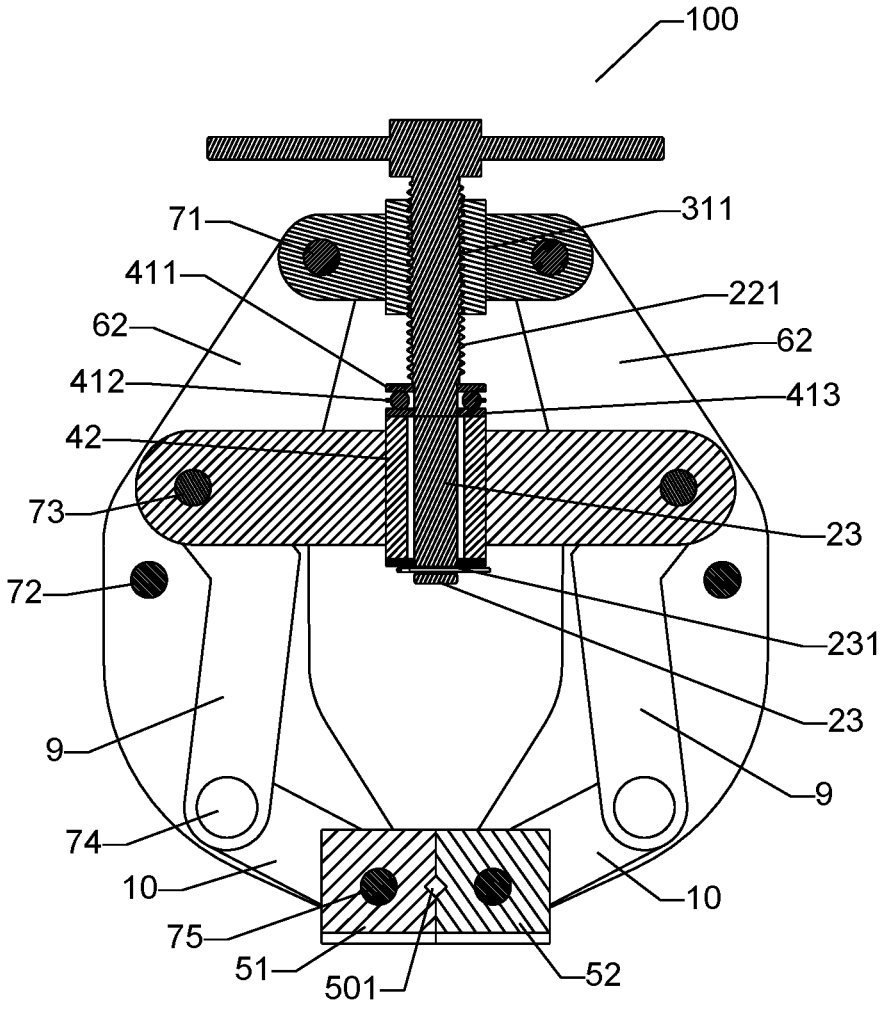
FIG. 4 shows a partial cross-section of an embodiment of a clamp.

FIG. 4. illustrates an embodiment of the clamp 100 in a partial cross-section. The base extensions 43 are rotationally coupled to the upper pusher connectors 73, and the base extensions 43 maintain a constant distance between the base 4 and the upper pusher connectors 73. As the base 4 moves towards the head 3, the upper pusher links 9 are required to rotate about the upper pusher connectors 73 and the abutments 5 move away from each other. As the base 4 moves away from the head 3, the arms 6 are required to rotate about the upper pusher connectors 73 and the abutments 5 move toward each other. In some embodiments, the geometry of the clamp 100, the abutments 5 contact each other when in the closed position. In some embodiments, the abutments 5 do not contact each other and there is a space between them when in the fully closed position. The distance between the abutments 5 in the closed position can be predetermined as desired.

Figure 5:
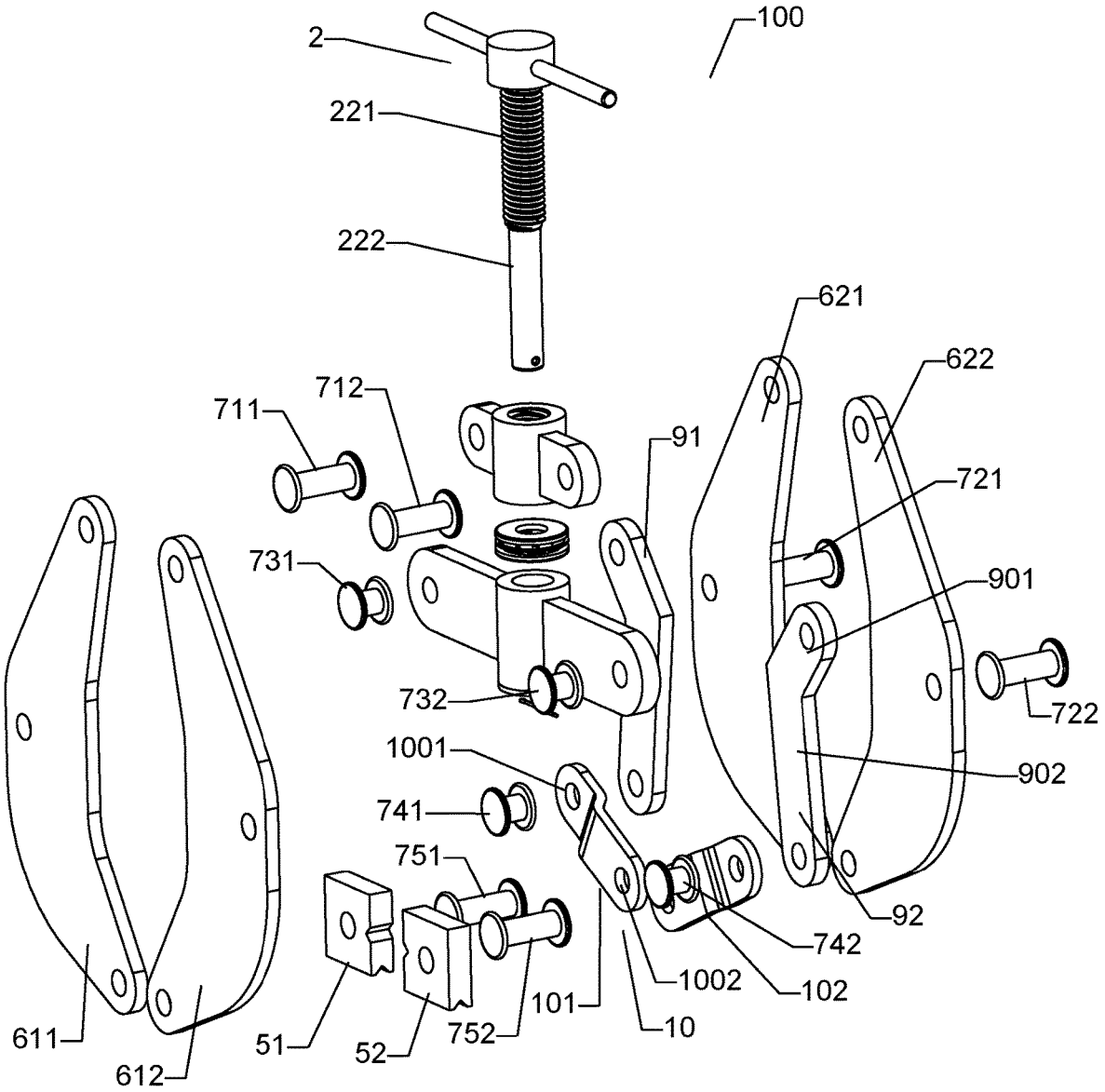
FIG. 5 shows an exploded view of an embodiment of a clamp.
Figure 6:
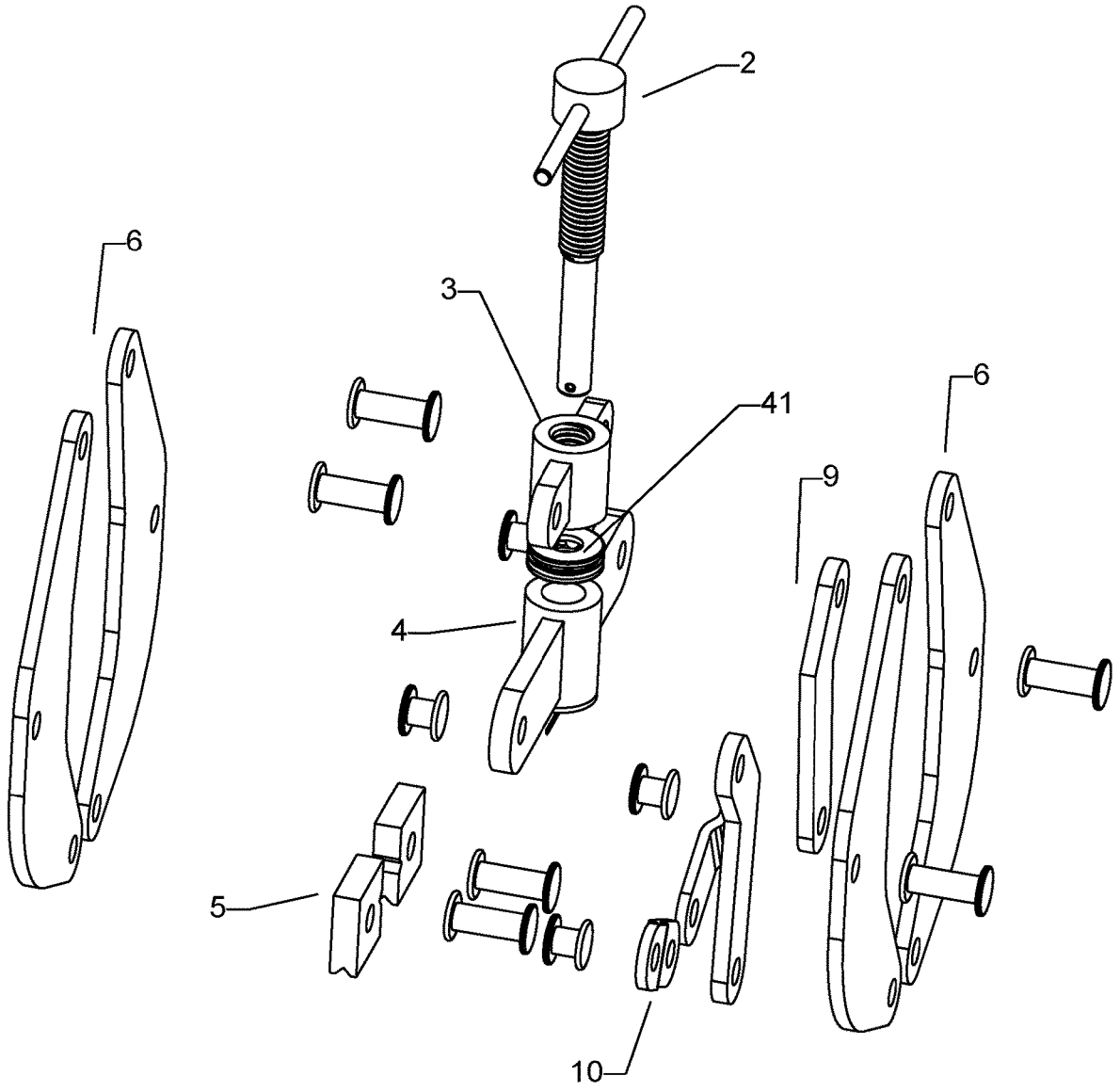
FIG. 6 shows an exploded view of an embodiment of a clamp.

FIGS. 5 and 6 illustrate embodiments of the clamp 100 in an exploded view. As can be seen, the actuator 2 comprises the head engagement 221 and a base engagement 222. The head 3 comprises a head collar 32 and head extensions 31 that are rotationally coupled to the front arms 61 and the rear arms 62 by the upper connectors 71. In some embodiments, the front arms 61 comprise a left front arm 611 and a right front arm 612. In some embodiments, the rear arms 62 comprise left rear arm 621 and a right rear arm 622.

In some embodiments, the upper connectors 71 comprise a left upper connector 711 and a right upper connector 712. In some embodiments, the base 4 is rotationally coupled to the upper pusher links 9 by the upper pusher connectors 73.

In some embodiments, the upper pusher links 9 comprise a left upper pusher link 91 and a right upper pusher link 92, and the upper pusher connectors 73 comprise a left upper pusher connector 731 and the right upper pusher connector 732.

In some embodiments, the front arms 61 are coupled to the rear arms 62 by the central connectors 72. In some embodiments, the left front arm 611 and the left rear arm 621 are coupled together by the left central connector 721, and the right front arm 612 and the right rear arm 622 are coupled together by the right central connector 722. In some embodiments, the central connectors 72 are located further from a center line of the clamp 100 than the upper connectors 71, the upper pusher connectors 73, the link connectors 74, the abutment connectors 75, or a combination thereof.

In some embodiments, the upper pusher links 9 are coupled to the lower pusher links 10 by the link connectors 74. In some embodiments, the lower pusher links 10 comprise a left lower pusher link 101, that is coupled to the left upper pusher link 91 by the left link connector 741, and a right lower pusher link 102, that is coupled to the right upper pusher link 92 by the right link connector 742.

In some embodiments, lower pusher links 10 are coupled to the abutments 5, the arms 6, or a combination thereof by abutment connectors 75. In some embodiments, the abutment connectors 75 comprise a left abutment connector 751 that is coupled to the left abutment 51, the left front arm 611, the left rear arm 621, or a combination thereof. In some embodiments, the abutment connectors 75 comprise a right abutment connector 752 that is coupled to the right abutment 52, the right front arm 612, the right rear arm 622, or a combination thereof.

In some embodiments, the lower pusher links 10 comprise of a lower pusher first section 1001 and a lower pusher second section 1002. In some embodiments, the lower pusher first section 1001 and the lower pusher second section 1002 reside in different planes.

In some embodiments, the upper pusher links 9 comprise an upper pusher first section 901 and an upper pusher second section 902. In some embodiments, the upper pusher first section 901 and the upper pusher second section 902 are set at an angle to each other. In some embodiments, the upper pusher first section 901 and the upper pusher second section 902 are located in different planes. In some embodiments, the upper pusher links 9 are angled inward.

Figure 7:
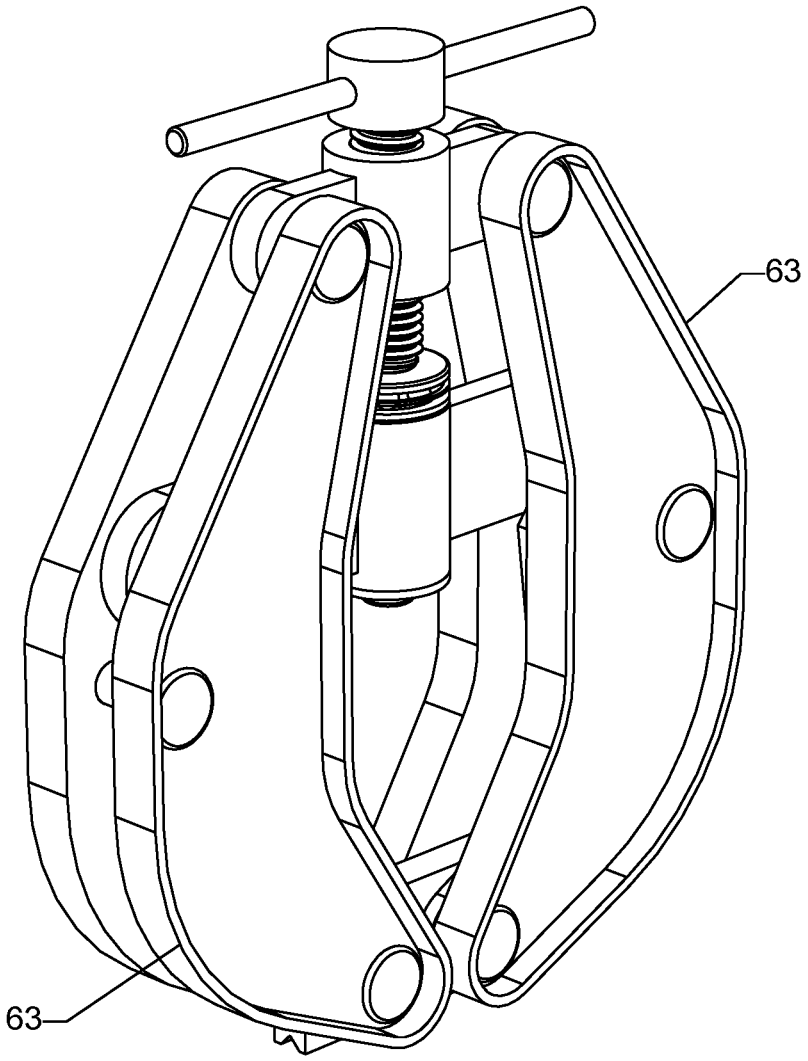
FIG. 7 shows an embodiment of a clamp.

FIG. 7 illustrates an embodiment of the clamp 100, wherein the arms 6 comprise a ridge 63. The ridge 63 is located on at least a portion of the periphery of the arm 6. In some embodiments, the ridge 63 extends along the entire periphery of the arms 6. In some embodiments, the ridge 63 will extends along one or more portions of the periphery of the arm 6.

When moving from the open position toward the closed position, the actuator 2 is rotated, the base 4 is pushed away from the head 3. When the base 4 moves away from the head 3, the upper pusher links 9, pushed by the base extensions 43, will push the lower pusher links 10, and the geometry of the upper pusher links 9 and the lower pusher links 10 will rotate the arms 6 about the upper connectors 71 toward the closed position.

When moving from the closed position toward the open position, the actuator 2 is rotated, and the base 4 is pulled toward the head 3. When the base 4 moves toward the head 3, the upper pusher links 9, pulled by the base extensions 43, will pull the lower pusher links 10, and the geometry of the upper pusher links 9 and the lower pusher links 10 will rotate the arms 6 about the upper connectors 71 toward the closed position.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

It should also be noted that elements of embodiments may be described in reference to the description of a particular embodiment; however it is disclosed that elements of disclosed embodiments can be switched with corresponding elements of embodiments with the same name and/or number of other disclosed embodiments.

Depending on the embodiment, certain steps of methods described may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

What is claimed is:

1. An apparatus comprising:

a clamp configured to move between an open position and a closed position, wherein the clamp comprises:

an actuator;

a head;

a base;

two or more arms upper connectors; and two abutments;

wherein the actuator extends through the head and the base; the two or more arms are coupled to the head and the base; the upper connectors couple the head to the two or more arms; and the two abutments abut each other when the clamp is in the closed position.

2. The apparatus of claim 1, wherein the actuator comprises an actuator extension; the actuator extension comprises a head engagement and a base engagement; the head engagement defines a thread that engages the head; and when the actuator rotates to move the clamp from the closed position toward the open position, the actuator pulls the base toward the head.

3. The apparatus of claim 2, wherein the base further comprises a stop; and the stop interacts with the actuator to push the base away from the head when the actuator rotates to move the clamp from the open position toward the closed position.

4. The apparatus of claim 1, wherein the base is coupled to the two or more arms by upper pusher connectors, upper pusher links, link connectors, lower pusher links and abutment connectors.

5. The apparatus of claim 4, wherein each upper pusher connectors comprises an upper pusher first section and a lower pusher second section, and the upper pusher first section and the lower pusher second section define an angle.

6. The apparatus of claim 4, wherein each lower pusher links comprise a lower pusher first section and an upper pusher second section, and the lower pusher first section and the upper pusher second section are in different planes.

7. The apparatus of claim 1, wherein the two or more arms comprise two front arms and two rear arms.

8. The apparatus of claim 7, wherein each abutment is coupled to one of the two front arms and one of the two rear arms.

9. The apparatus of claim 7, wherein the two front arms comprise a right front arm and a left front arm, and the two rear arms comprise a right rear arm and a left rear arm; and the right front arm and the right rear arm are coupled together by a right central connector, and the left front arm and the left rear arm are coupled together by a left central connector.

10. The apparatus of claim 7, wherein the two front arms comprise a right front arm and a left front arm, and the two rear arms comprise a right rear arm and a left rear arm; the two abutments comprise a right abutment and a left abutment; the right front arm and the right rear arm are coupled together by a right central connector, together and to the head by a right upper connector, and together and to the right abutment by a right abutment connector; and the left front arm and the left rear arm are coupled together by a left central connector, together and to the head by a left upper connector, and together and to the left abutment by a left abutment connector.

11. The apparatus of claim 1, wherein the base comprises a stop, and the stop comprises bearings or an o-ring.

12. The apparatus of claim 1, wherein the stop abuts the head in the open position.

13. The apparatus of claim 1, wherein at least one of the two or more arms define a ridge along at least a portion of a periphery thereof.

14. The apparatus of claim 7, wherein at least one of the two front arms and the two rear arms define a ridge along at least a portion of a periphery thereof.

15. The apparatus of claim 14, wherein the two front arms comprise a right front arm and a left front arm, and the two rear arms comprise a right rear arm and a left rear arm.

16. The apparatus of claim 1, wherein the base defines a base center and the actuator comprises an actuator-base engagement; and the actuator-base engagement is free to rotate within the base center.

17. The apparatus of claim 2, wherein the actuator further comprises a plate, and the plate abuts the base.

18. An apparatus comprising:

a clamp configured to move between an open position and a closed position, wherein the clamp comprises:

an actuator comprising a plate;

a head;

a base comprising a stop, when the stop comprises bearings or an o-ring;

two or more arms; and two abutments;

wherein the actuator extends through the head and the base; the two or more arms are coupled to the head and the base; the plate abuts the base; and the two abutments abut each other when the clamp is in the closed position.

19. An apparatus comprising:

a clamp configured to move between an open position and a closed position, wherein the clamp comprises:

an actuator;

a head;

a base;

two or more arms;

a stop; and two abutments;

wherein the actuator extends through the head and the base; the two or more arms are coupled to the head and the base; the stop abuts the head in the open position; and the two abutments abut each other when the clamp is in the closed position.

* * * * *